United States Patent [19]

Naylor

[11] 4,161,845

[45] Jul. 24, 1979

[54] INVERTIBLE PREFABRICATED DOOR

[76] Inventor: Donald B. Naylor, 1013 N. Michigan St., Plymouth, Ind. 46563

[21] Appl. No.: 607,028

[22] Filed: Aug. 22, 1975

[51] Int. Cl.[2] ..... E06B 3/32
[52] U.S. Cl. ..... 49/380
[58] Field of Search ..... 49/380, 382

[56] References Cited

U.S. PATENT DOCUMENTS

| | | | |
|---|---|---|---|
| 2,930,480 | 3/1960 | Brown | 49/380 X |
| 3,796,008 | 3/1974 | Eakin | 49/380 |

FOREIGN PATENT DOCUMENTS

| | | | |
|---|---|---|---|
| 114857 | 9/1945 | Sweden | 49/380 |

*Primary Examiner*—Kenneth Downey
*Attorney, Agent, or Firm*—Oltsch, Knoblock & Hall

[57] ABSTRACT

A prefabricated door assembly which includes a panel, a pair of jambs and two combined header and thresholds. The jambs and combined header and thresholds form a rectangular frame into which is fitted the door panel. The panel is pivotally hinged to one of the jambs. Each combined header and threshold is adapted to be mounted either upon a foundation or under an overhead support, depending upon the vertical orientation of the panel and location of the door hinge.

1 Claim, 5 Drawing Figures

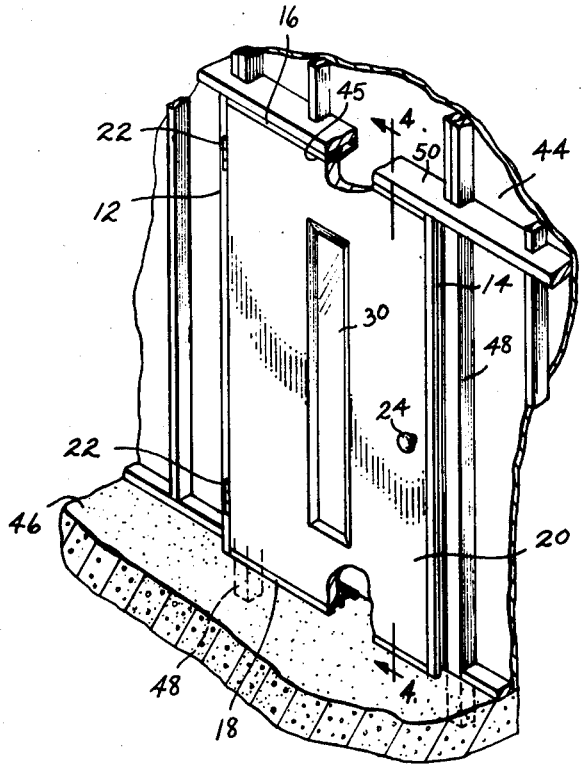

Fig. 3
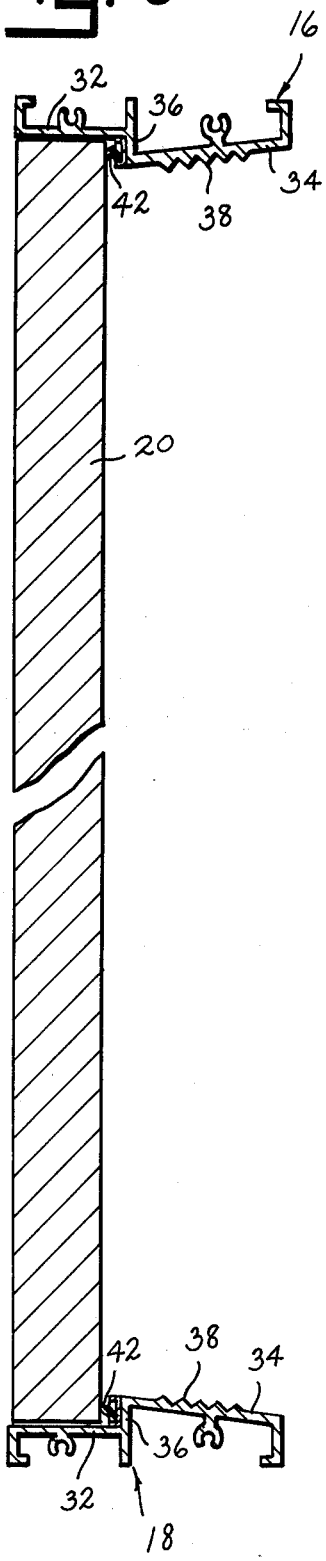
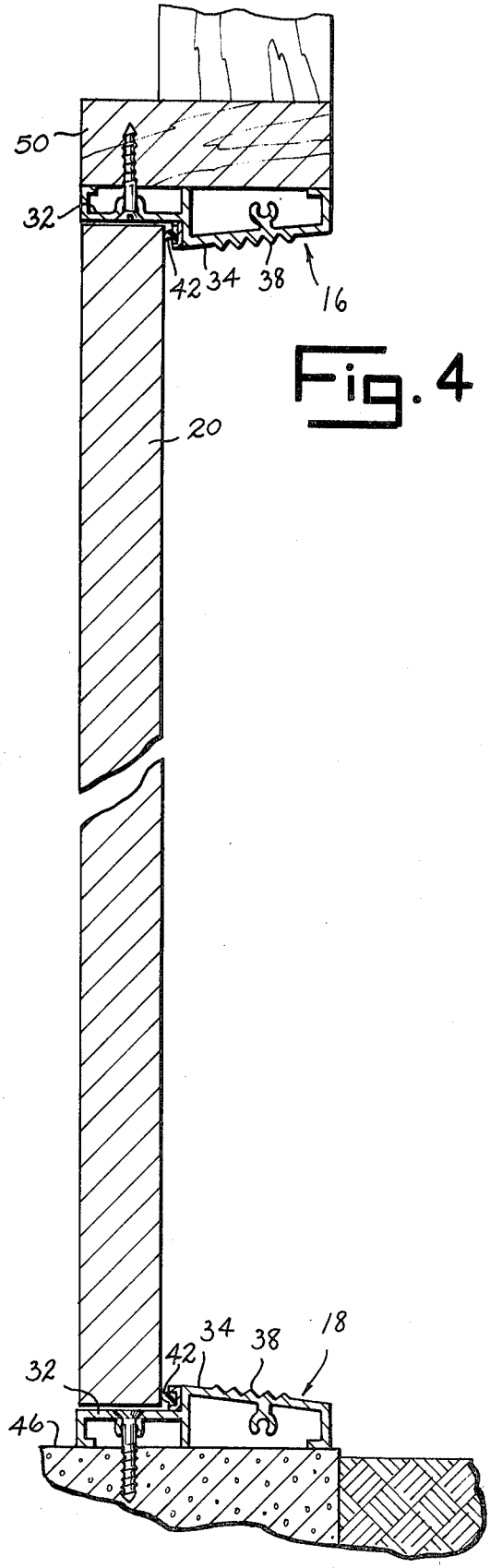
Fig. 4

INVERTIBLE PREFABRICATED DOOR

SUMMARY OF THE INVENTION

This invention relates to a prefabricated door assembly and will have specific application to a door which can be inverted during its installation, depending upon the desired direction of swing of the door panel.

In the door assembly of this invention there is a panel which is hinged for pivotal movement to one of a pair of jambs. Enclosing the panel at its upper and lower edges is a pair of combined header and threshold means. The two jambs and two header and threshold means define a frame into which the door panel is fitted. Hinge means pivotally connect the door panel to one of the door jambs. Each combined header and threshold means is adapted for mounting either upon a foundation or under an overhead support, depending upon the desired vertical orientation of the panel and location of the assembly hinge means.

To mount the door assembly within a wall opening, the assembly is first rotated or inverted, if necessary, to place the hinge means at one specific side of the door panel, depending upon the desired direction of opening movement of the door. The assembly is then set into the wall opening with one of the combined header and threshold means resting upon the foundation. In this manner, one prefabricated door assembly can be utilized as a right or left-hand opening door, depending upon the vertical orientation of the assembly when fitted into the wall opening.

Accordingly, it is an object of this invention to provide a prefabricated door assembly which may be inverted to accommodate either left or right-hand opening movement of the door panel of the assembly.

Another object of this invention is to provide an invertible prefabricated door assembly which is of economical construction.

Still another object of this invention is to provide an invertible prefabricated door assembly which may be mounted within a wall opening through the utilization of simple hand tools.

Still another object of this invention is to provide an invertible prefabricated door assembly which is mountable in a rapid and simple manner.

Other objects of this invention will become apparent upon a reading of the inventions's description.

BRIEF DESCRIPTION OF THE DRAWINGS

A preferred embodiment of this invention has been chosen for purposes of illustration and description wherein:

FIG. 3 is a vertical cross sectional view of the door assembly taken along line 3—3 of FIG. 2.

FIG. 4 is a vertical cross sectional view of the door assembly taken along line 4—4 of FIG. 1.

DESCRIPTION OF THE PREFERRED EMBODIMENT

Figure 1:
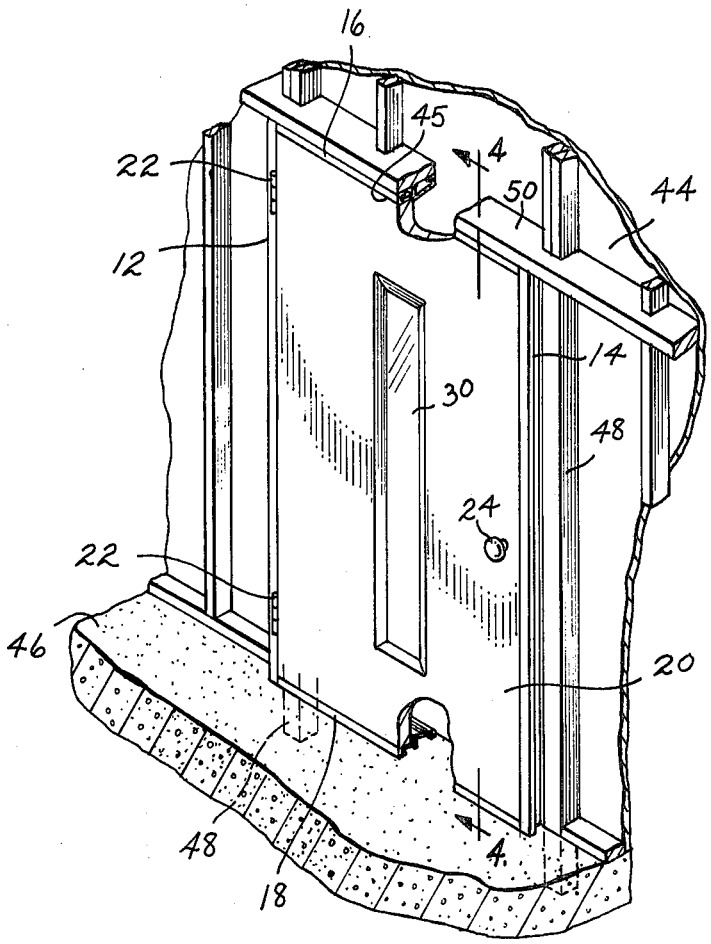
FIG. 1 is a perspective view of the door assembly fitted within a wall opening.
Figure 2:
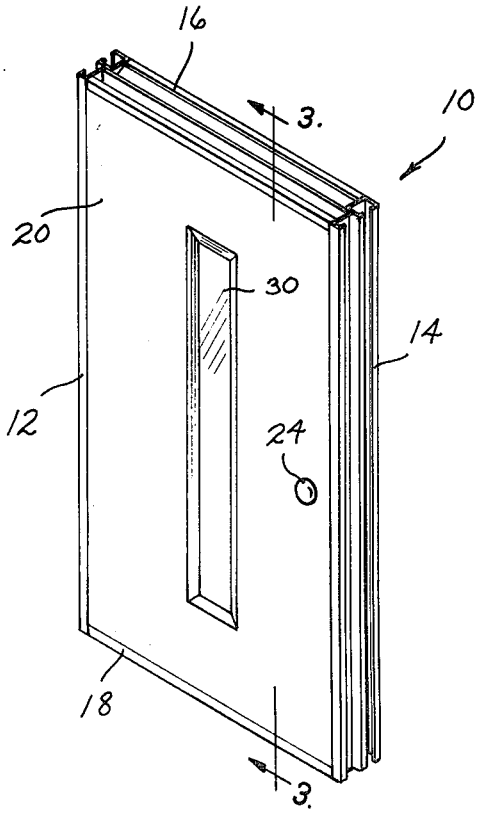
FIG. 2 is an isolated perspective view of the door assembly.
Figure 5:
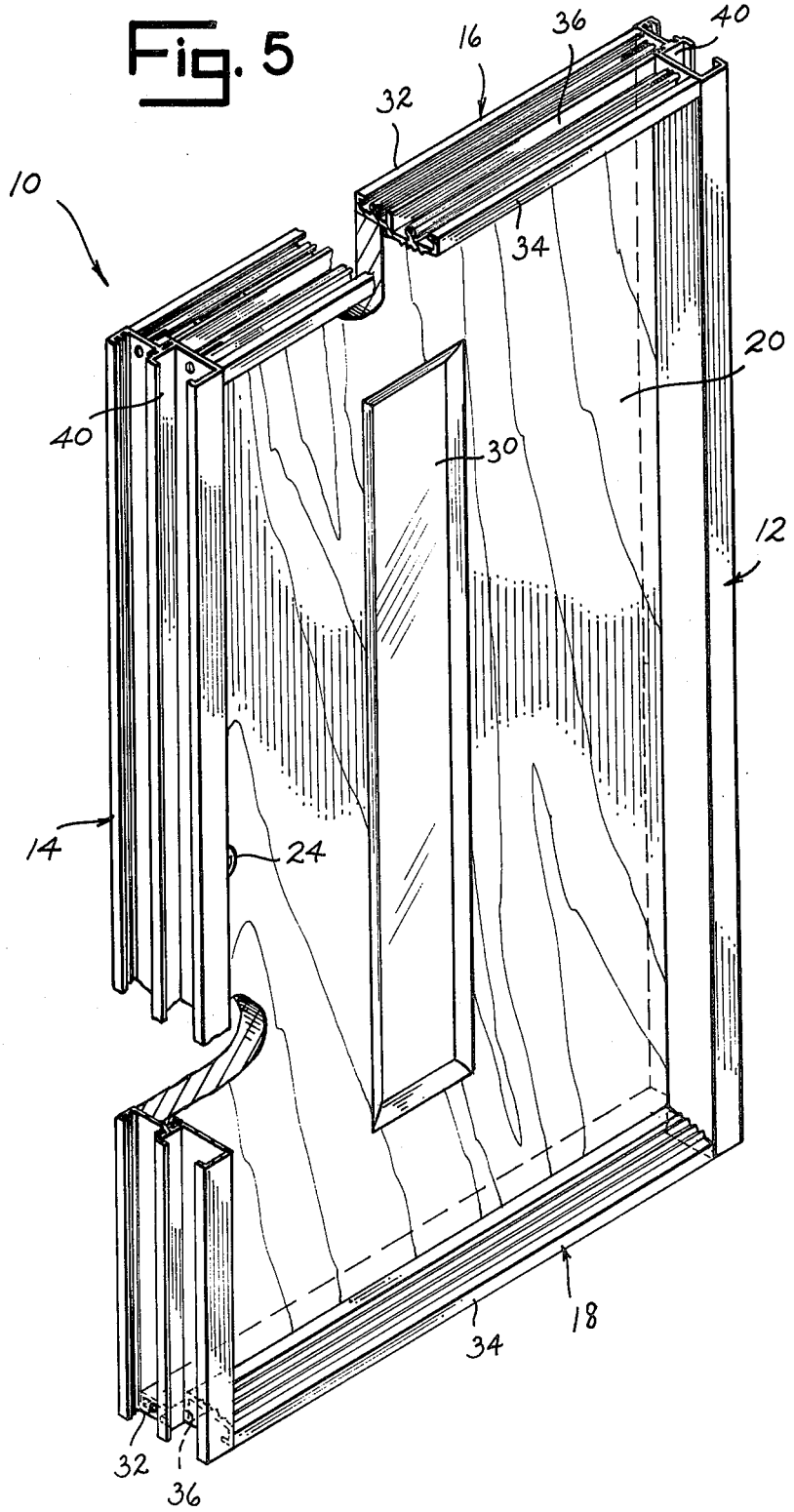
FIG. 5 is a perspective view of the isolated door assembly with portions broken away for purposes of illustration as seen from its opposite side.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Door assembly 10 includes jambs 12 and 14, a combined header and threshold 16 and another combined header and threshold 18. Jambs 12 and 14 and header and thresholds 16 and 18 are connected together at their respective end portions to define a rectangular frame into which a door leaf or panel 20 is fitted. Hinges 22 secure door panel 20 to jamb 12, enabling the door to be pivoted between open and closed positions. Located an equal distance between header and thresholds 16 and 18 is a door handle 24 and associated latch. A striker plate is carried by jamb 14 for the purpose of engaging the door latch to secure door panel 20 in its closed position. If desired, a centered window 30 may be located in door panel 20.

Combined header and thresholds 16 and 18 are of like construction. Each header and threshold 16 and 18 includes a plate part 32 and an offset plate part 34 separated by a shoulder 36. Plate part 34 may be angled as shown in the drawings. Additionally, the outer surface of plate part 34 of each header and threshold 16 and 18 may be provided with longitudinally extending serrations 38. Each jamb 12 and 14 includes offset parts connected by a shoulder 40 which lies in the same plane as shoulder 36 of each header and threshold 16 and 18. Shoulders 36 and 40 are overlapped by the marginal edges of door panel 20 when the panel is in its closed position with its latch extending into the latch opening in the striker plate. Weatherstripping 42 is applied to shoulders 26 and 30. When contacted by door panel 20 in its closed position, weatherstripping 42 serves to seal the panel around jambs 12 and 14 and combined header and thresholds 16 and 18.

In FIG. 1 door assembly 10 is shown fitted into an opening within side wall 44 of a building structure. The opening 45 in side wall 44 is defined by a foundation 46, which may be concrete, wood or of earthen composition, side stanchions 48 and an interconnecting overhead support 50. Wall opening 45 is sized so as to receive door assembly 10 with slight clearance. Door assembly 10 is positioned, such as by inverting the door assembly if necessary, to locate hinges 22 at one selected assembly side so as to enable door panel 20 to have either a left or right-hand opening and closing swing as desired. Any inversion of door assembly 10 other than changing the orientation or location of hinges 22 and door handle 24 will not change the method by which the assembly is fitted and secured within opening 45 in side wall 44 due to the similarity in construction of header and thresholds 16 and 18. Once door assembly 10 is fitted into wall opening 45, screws or similar attachment means are turned through jambs 12 and 16 and combined header and thresholds 16 and 18 into underlying stanchions 48 and overhead supports 50 to secure the assembly to wall 44.

From the above description it can be appreciated how easily prefabricated door assembly 10 with its combined header and thresholds 16 and 18 can be mounted in a wall opening while giving the door user an option of having either a right or left-hand opening door, without changing or otherwise modifying the door assembly. It is also to be further understood that the invention is not to be limited to the details above given but may be modified within the scope of the appended claims.

What I claim is:

1. An invertible prefabricated door assembly for mounting within a wall opening defined by a foundation and overhead support, said door assembly comprising a panel, first and second jambs, a first combined header and threshold means, a second combined header and threshold means, said jambs and both combined header and threshold means forming a four-sided enclosed frame, said panel fitting within said frame and having opposite vertical side edges, hinge means pivotally connecting said panel at one side edge to said first jamb, each of said first and second combined header and threshold means for mounting either to the foundation or the overhead support of a said wall opening depending upon the desired location of said hinge means, each combined header and threshold means including a first part which said panel overlaps when closed and a second part extending substantially forwardly of said first part to define a grooved panel, said first part being offset from said second part and separated therefrom by a shoulder constituting a portion of each combined header and threshold means, said panel having upper and lower marginal edges, said upper panel marginal edge overlying the shoulder of said first combined header and threshold means and said lower marginal panel edge overlying the shoulder of said second combined header and threshold means when said panel is closed.

* * * * *